United States Patent [19]

Adcock

[11] 3,952,819

[45] Apr. 27, 1976

[54] FATIGUE RESISTANT ANVIL BIT FOR PERCUSSION ROCK DRILL

[75] Inventor: Gerald L. Adcock, Lewiston, Idaho

[73] Assignee: A & W Deep-Well Drilling, Inc., Lewiston, Idaho

[22] Filed: Mar. 10, 1975

[21] Appl. No.: 556,673

[52] U.S. Cl. ..... 175/293; 173/80; 173/131; 175/389; 175/410; 403/273

[51] Int. Cl.[2] ..... E21B 1/06; E21B 9/22

[58] Field of Search ... 175/409–411, 293, 135, 92, 175/389, 390, 320, 414–420; 173/131, 80; 403/273, 343, 118, 403/306, 307

[56] References Cited

UNITED STATES PATENTS

| | | | |
|---|---|---|---|
| 58,650 | 10/1866 | King | 175/320 |
| 1,477,855 | 12/1923 | Thurston | 175/320 |
| 2,239,461 | 4/1941 | Mann | 175/412 X |
| 2,569,275 | 9/1951 | Baker | 403/273 X |
| 2,673,715 | 3/1954 | Baker | 175/409 |
| 2,759,705 | 8/1956 | Bjorkman | 175/419 X |
| 2,942,578 | 6/1960 | Huffman et al. | 175/92 X |
| 3,061,025 | 10/1962 | Stockard | 175/412 |
| 3,322,216 | 5/1967 | Kurt | 175/293 |

*Primary Examiner*—John E. Murtagh
*Assistant Examiner*—Richard E. Favreau
*Attorney, Agent, or Firm*—Wells, St. John & Roberts

[57] ABSTRACT

A fatigue resistant anvil bit is described for use on a percussion rock drill. The anvil bit has a shank having a substantially uniform cross section terminated in a threaded end portion. A bit head is threadably mounted on the end portion having a diameter substantially greater than the bit shank. An anvil ring is shrunk fit on the shank engaging the bit head to provide lateral support and minimize the creation of fatigue fractures.

9 Claims, 4 Drawing Figures

FATIGUE RESISTANT ANVIL BIT FOR PERCUSSION ROCK DRILL

BACKGROUND OF THE INVENTION

This invention relates to percussion rock drilling equipment and more particularly to rock drill bits for percussion drills.

Drilling through earth rock is generally a rather expensive procedure because of the initial capital costs and the rather large expense required to maintain the equipment in operation. One of the major costs relates to the frequent replacement of drill bits. A rock drill bit generally has a rather short life depending upon various factors including the diameter of the hole. Applicant has found that most commercially available rock drill bits for drilling 6–10 inch holes generally break from fatigue within 500 feet of rock drilling operation. The casualty rate for single rock drilling bits capable of drilling larger holes of 10–18 inches is even greater. As stated in Kurt et al U.S. Pat. No. 3,144,084 granted Aug. 11, 1964, it has not been economically practical to use single rock drilling bits for drilling holes much larger than 9 inches in diameter. The Kurt et al patent suggests that gang drills with multiple bits be used for drilling holes greater than 9 inches.

The problem is even more drastically compounded when a single enlarged anvil bit is utilized for forming or drilling holes having diameters between 9 and 16 inches.

FIG. 1 illustrates a conventional anvil bit for drilling holes of 8–10 inches in diameter that has failed under fatigue. Fracture locations A and B are indicated at the locations where the fatigue fractures normally occur causing bit failure. FIG. 2 illustrates a conventional large diameter anvil bit that has been utilized for drilling rock holes with diameters between 10 and 16 inches. Fracture locations C and D indicate locations where such large diameter art anvil bits normally fail from fatigue.

One of the principal objects of this invention is to provide a new anvil bit that is much more fatigue resistant giving it a considerably longer life.

An additional object of this invention is to provide a new anvil bit design which enables a single anvil bit to be utilized for drilling larger diameter holes than previously.

A further object of this invention is to provide a new anvil bit design which considerably reduces the replacement costs should the anvil bit fail.

An additional object of this invention is to provide an anvil bit for a percussion rock drill that is less expensive to manufacture, yet has a longer life than previous anvil bits.

These and other objects and advantages of this invention will become apparent upon reading the following detailed description of a preferred embodiment.

BRIEF DESCRIPTION OF THE DRAWINGS

A preferred and alternate embodiment of this invention as illustrated in the accompanying drawings, in which.

DETAILED DESCRIPTION OF THE PREFERRED AND ALTERNATE EMBODIMENTS

Figure 1:
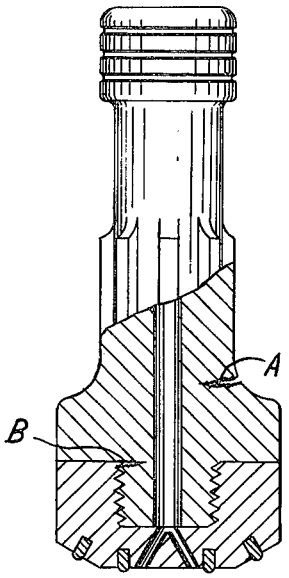
FIG. 1 is a cross-sectional view of a prior art anvil bit showing the locations of the most frequent failure points.
Figure 2:
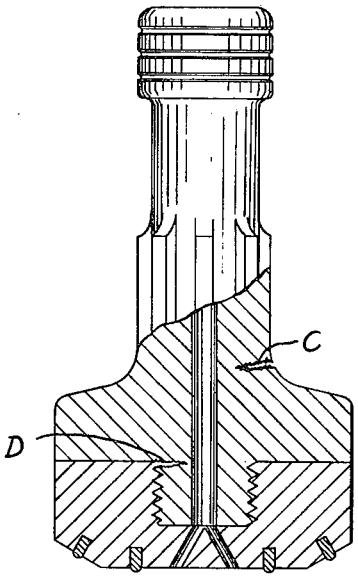
FIG. 2 is a cross-sectional illustration view of a large hole anvil bit of the prior art illustrating locations of fatigue fracture most frequently incurred.

Referring in more detail to the drawings, FIG. 1 shows a prior art two piece anvil bit for drilling 6–10 inch diameter holes in rock, showing locations A and B where fatigue fractures most frequently occur during the drilling operation. FIG. 2 illustrates a prior art anvil bit utilized for drilling larger diameter holes generally between 10 and 18 inches. Both drill bits are used on a conventional percussion drill having a casing outside diameter of about 6½ inches.

Figure 3:
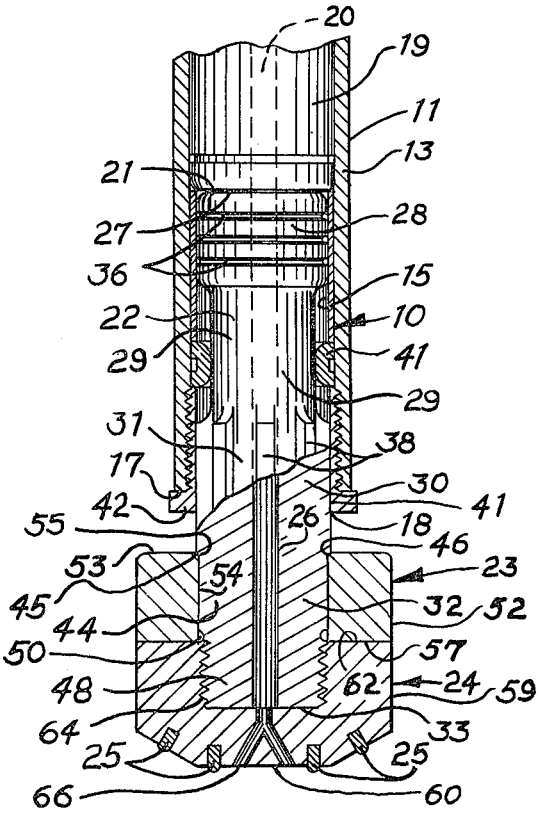
FIG. 3 is a fragmentary cross-sectional view of a percussion rock drill with an anvil bit mounted therein illustrating the principal features of this invention.
Figure 4:
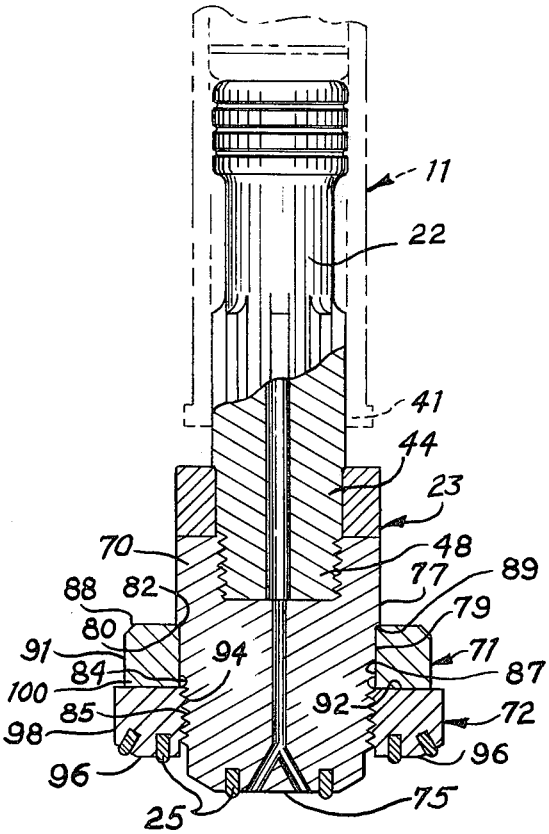
FIG. 4 is a fragmentary cross-sectional view similar to FIG. 3 except showing an alternate embodiment of an anvil bit for drilling larger diameter holes.

The applicant's new design is illustrated in a preferred and alternate embodiment in FIGS. 3 and 4 respectively. FIG. 3 illustrates applicant's new anvil bit 10 mounted on a down-hole percussion rock drill 11. The rock drill 11 has a mechanism for delivering periodic impacts to the anvil bit during the drilling of the hole. A 6½ inch diameter drill is generally utilized for drilling holes in rocks of 7 to 12 inches.

A partial description of the percussion rock drill is helpful to fully understand the importance of the applicant's invention and relationship therebetween. The percussion rock drill 11 has a cylindrical elongated casing 13 having a predetermined outside diameter. There are various conventional rock percussion rock drills having outside diameters of approximately 3–10 inches. For example a percussion rock drill of 6½ OD cylindrical bore 15 formed therein of a selected diameter generally in the neighborhood of approximately 5½ inches ID. The cylindrical bore has a forward or bottom end 17 forming an opening of a predetermined diameter generally in the neighborhood of 5½ inches. The piston 19 is reciprocally mounted within cylinder bore 15 to serve as a hammer to provide periodic impacts to the anvil bit to drive the anvil bit through the rock. The piston has a central passageway 20 to permit the flow of a fluid through the piston and through the anvil bit to cause the broken rock to be flushed from the bottom of the hole. The piston 19 has an impact end 21 for periodically impacting the anvil bit 10.

The anvil bit 10 includes (1) an anvil body 22 generally of cylindrical configuration, (2) an annular anvil ring 23 and (3) a bit head 24. The bit head 24 has a plurality of cutting or inserted elements 25, generally of tungsten carbide mounted therein for performing the cutting action against the rock at the bottom of the hole.

The anvil body is elongated and extends between an impact or rear end 27 and a bit or forward end 33. The anvil body 22 has an elongated anvil head section 28 adjacent the impact or rear end 27. Enlarged anvil head section 28 has a diameter corresponding to the cylinder bore 15 for sliding engagement therewith. The anvil body 22 has a shank 29 extending from the enlarged anvil head section 28 to the bit forward end 33. The shank 29 is divided into three sections — a lock ring section 30, a spline section 31, and a shank section 32. The sections 30 and 31 extend from the head section 28 to the opening 18. Section 32 extends from the opening 18 of the drill bit terminating at the bit forward end 33. A very important aspect of this invention is that the shank from the spline section 31 to the forward end 33 has a substantially uniform cross section. It is preferable that the cross section not vary in diameter more than the maximum deviation of 0.5 inches from the spline section 31 to the forward end 33.

The enlarged anvil head section 28 frequently has annular grooves 36 formed therein forming seal grooves to enclose cylindrical bore 15. Various other types of seal arrangements can be utilized. The spline section 31 generally has a plurality of longitudinal splines 38 formed thereon for the purpose of preventing the annular bit 10 from rotating with respect to the percussion rock drill 11.

Anvil bit 10 is held in cylindrical bore 15 by a drill chuck 40. The chuck 40 is generally formed with a lock ring 41 that is mounted in a cylindrical bore 15 and received about the lock ring section 30. An annular collar 42 is mounted about the opening 18 having an interior diameter defining the opening 18. The collar 42 holds the lock ring 41 in place. The lock ring 41 prevents the anvil bit from dropping from the rock drill.

The shank section 32 is formed of two general portions — a ring receiving portion 44 and a threaded end portion 48. The ring receiving portion 44, in a preferable form, has a slightly reduced diameter from the spline section 31 forming a concave radius 45 at the intersection between the ring receiving portion 44 and the spline section 31 defining a shoulder 46. Preferably the reduced diameter portion 44 has a diameter of between 0.062 and 0.125 inches less than the spline section 31. A relief groove 50 is formed between the ring receiving portion 44 and the threaded portion 48. In a preferred embodiment, the threaded portion 48 also has a slightly reduced diameter from the ring receiving portion 44. Preferably the reduction is in the neighborhood of 0.062 to 0.125 inches in diameter. It is important that the maximum deviation in the cross section along the shank section 32 not exceed 0.5 inches in diameter.

The annular anvil ring 23 is an extremely important component of the annular bit and is mounted on the ring receiving portion 44 of the shank section 32 in an interference shrink fit. Preferably the interference shrink fit is between 0.002 and 0.004 inches per inch of diameter of the shank section 32. The annular ring 23 has a cylindrical outer surface 52 having a diameter greater than the casing diameter. In some embodiments it may be desirable to form longitudinal grooves along the cylindrical surface 52 to enable broken rock components to be flushed from the bottom of the hole. The anvil ring 23 has a rear surface 53 that forms a convex radius 55 with an inner annular surface 54. The inner annular surface 54 is in interference shrink fit with the ring receiving portion 44. The convex radius 55 is complementary to the concave radius 45 with a portion of the rear surface 53 engaging the shoulder 46. The annular ring 23 has a forward surface 57 that extends radially outward from the shaft section 32 adjacent the relief groove 50.

The bit head 24 is preferably of a cup shape having a cylindrical outer surface 59 with a diameter greater than the outer diameter of casing 13 and corresponding to a desired diameter of the hole. The bit head 24 has a working face surface 60 in which the cutting insert elements 25 are imbedded. The bit head 24 has a rear surface 62 that extends radially outward from shaft section 32 in which the rear surface 62 is complementary to and engaging surface 57. The annular ring 23 provides significant lateral support to the bit head 24. The bit head 24 has a threaded bore 64 for mounting on the threaded portion 48 of the shank. Fluid holes 66 are formed in the bit body 24 communicating with a central passageway 26 of the anvil body to permit the fluid to flow from the percussion rock drill through the anvil bit to the bottom of the hole to flush rock components from the bottom of the hole.

The anvil bit 10 illustrated in FIG. 4 is designed for drilling large diameter holes generally between 10 and 16 inches utilizing a standard rock drill. In FIG. 4 the anvil bit instead of having a bit head 24 has a pilot bit head 70 with a second anvil ring 71 and a bit ring 72 mounted thereon.

The pilot bit head 70 has a cylindrical substantially uniform cross section terminating in a face 75 that has a plurality of cutting insert elements 25 mounted therein. The pilot bit head 70 has a cylindrical side surface 77 with a second anvil ring receiving portion 79 that has a slightly reduced diameter of between 0.062 and 0.125 inches in diameter reduction. The portion 79 is formed with a radius 80 forming a shoulder 82. The head 70 has a threaded portion 85 with a groove 84 formed between the threaded portion 85 and the anvil ring portion 79. The preferred form of the threaded portion 85 has a slightly reduced diameter from portion 79. Preferably the diameter reduction is between 0.062 and 0.125 inches. It is important that the maximum deviation in the cross section along the pilot bit head not exceed 0.5 inches in diameter.

The second anvil ring 71 has an interior surface 87 that is in shrink interference fit with the portion 79. Preferably the shrink interference fit is between 0.002 and 0.004 inches per inch of diameter of the portion 79. The anvil ring 71 has a rear surface 88 engaging the shoulder 82. A radius 89 is formed between the interior surface 87 and the rear surface 88 which is complementary to the radius 80. The ring 71 has a cylindrical outer surface 91 having a diameter substantially greater than the diameter of the portion 79, and substantially greater than the outside diameter of the percussion rock drill 11. The ring 71 has a forward surface 92 for mating with the bit ring 72.

The bit ring 72 has an interior threaded bore 94 and a face 96 that has a plurality of cutting insert elements formed therein. The bit ring 72 includes a cylindrical outer surface 98 that has a diameter that is complementary to the desired diameter of the hole. Preferably the outer diameter of surface 98 is between 10 and 16 inches.

The bit ring 72 includes a back surface 100 that is complementary to and in engagement with the forward surface 92 of the anvil ring 71. The anvil ring 71 provides substantial lateral support to the bit ring 72 while at the same time minimizing the fatigue concentrations in the pilot bit head 70.

Almost all rock drill anvil bits are heated to increase their hardness. The anvil bits illustrated in FIGS. 3 and 4 are more easily uniformly heat treated than the anvil bits illustrated in FIGS. 1 and 2. The anvil bodies 22 and the pilot bit head 70 because of their substantially uniform diameter can be more uniformly heat treated. The anvil ring 23 and the anvil ring 71 are separately heat treated before they are assembled to obtain more uniformity and to lessen the internal stresses created by differential heat treatment. The anvil ring 23 and 71 are heated to a temperature below the tempering temperature of the material during the interference shrink fitting process.

The anvils illustrated in FIGS. 3 and 4 have a considerably longer life than the anvils shown in FIGS. 1 and 2. For example, generally the applicant has found that the anvil illustrated in FIG. 1 will fracture before drilling 500–700 feet. With the anvil illustrated in FIG. 3, the applicant is able to drill more than two thousand feet through rock without breakage. Additionally, the anvils illustrated in FIGS. 3 and 4 cost less in material cost and additionally cost less in tooling thus substantially reducing the manufacturing cost while extending the life of the bits. Even more importantly the applicant is able to construct anvil bits that are able to drill up to 18 inches in diameter utilizing a single conventional percussion rock drill.

It should be understood that the above described embodiments are simply illustrative of the principals of this invention and that numerous other embodiments may be readily devised by those skilled in the art without deviating therefrom. Therefore, only the following claims are intended to define this invention.

What is claimed is:

1. A fatigue resistant anvil bit for a percussion rock drill, comprising:

an elongated anvil body having a rear impact end with an anvil head section of a prescribed diameter and having an integrally formed shank extending from the rear end to a threaded bit end in which the diameter of shank from the anvil head section to the threaded end does not exceed the prescribed diameter of the anvil head section;

an enlarged removable bit head threadably mounted on the threaded bit end with a plurality of cutting elements mounted in a face surface thereof; said enlarged bit head having a rear surface extending laterally from the shank; and an enlarged anvil ring shrunk fit on the shank adjacent the threaded bit end having a forward support surface complementary to and engaging the rear surface of the bit head to provide lateral support to the bit head without increasing the cross section of the anvil body adjacent the threaded bit end.

2. The anvil bit as defined in claim 1 wherein the anvil ring has a shrink interference fit with the shank of between 0.002 and 0.004 inches per inches of diameter of the shank.

3. The anvil bit as defined in claim 1 wherein the diameter of the shank on which the anvil ring is shrunk fit and the diameter of the threaded bit end is less than the determined diameter of the anvil head section.

4. The anvil bit as defined in claim 1 wherein the bit head is a pilot bit head and wherein the anvil bit further comprises:

an enlarged bit ring secured about the pilot bit having a plurality of cutting elements mounted in a face thereof and having a rear surface extending laterally outward from the pilot bit; and an enlarged second anvil ring shrunk fit on the pilot bit head rearward of the enlarged bit ring and having a forward support surface complementary to and engaging the rear surface of the enlarged bit ring to provide lateral support to the bit ring without increasing the cross section of the pilot bit.

5. The anvil bit as defined in claim 1 wherein the shank has a splined section of a predetermined diameter intermediate the rear end and the threaded bit end and wherein the diameter of the shank from the splined section to the termination of the threaded bit end is equal to or less than the predetermined diameter of the splined section.

6. The anvil bit as defined in claim 5 wherein the shank from the spline section to the termination of the threaded bit end is substantially uniform in cross section with a maximum exterior diameter deviation of 0.25 inches.

7. A fatigue resistant anvil bit for a percussion rock drill having a predetermined casing diameter and an interior opening of a predetermined diameter to receive the anvil bit, said anvil bit comprising:

an elongated anvil body for mounting in the interior opening in which the anvil body has a shank section for extending from the drill opening and terminates in a forward end;

said projecting shank section having substantially uniform cross section not exceeding the opening diameter of the rock drill;

an enlarged bit head removably mounted on the shank section forward end having a plurality of cutting insert elements mounted in a face surface thereof;

said bit head having a diameter greater than the drill casing diameter with a rear surface extending radially outward from the shank section; and an enlarged anvil ring shrunk fit on the shank section and having a diameter greater than the drill casing diameter; said anvil ring having a forward surface complementary to and engaging the rear surface of the bit head.

8. The anvil bit as defined in claim 7 wherein the anvil body has a spline section for receiving in the interior opening of the rock drill and wherein the shank section has a diameter equal to or less than the diameter of the spline section.

9. The anvil bit as defined in claim 7 wherein the shank section is substantially uniform with the maximum exterior diameter deviation of 0.25 inches.

* * * * *